US005979027A

United States Patent [19]

Oh et al.

[11] Patent Number: 5,979,027

[45] Date of Patent: Nov. 9, 1999

[54] PLASTIC FASTENER

[75] Inventors: Hieyoung W. Oh, Bennington, N.H.; Roger J. Archambault, Blackstone, Mass.

[73] Assignee: Avery Dennison Corporation, Pasadena, Calif.

[21] Appl. No.: 08/886,907

[22] Filed: Jul. 2, 1997

[51] Int. Cl.[6] ..... G09F 3/12

[52] U.S. Cl. ..... 24/704.1; 24/711.1

[58] Field of Search ..... 24/300, 711.1, 24/102 A, 713.1, 573.1, 72.7, 704.1; 206/343, 345, 346, 344, 347, 348

[56] References Cited

U.S. PATENT DOCUMENTS

| | | | |
|---|---|---|---|
| 4,187,590 | 2/1980 | Harris et al. | 24/102 A X |
| 4,534,464 | 8/1985 | Lankton | 24/711.1 X |
| 4,603,326 | 7/1986 | Freed . | |
| 4,769,875 | 9/1988 | Hartman | 24/300 |

*Primary Examiner*—James R. Brittain

*Attorney, Agent, or Firm*—Kriegsman & Kriegsman

[57] ABSTRACT

A plastic fastener for use in tagging an article of commerce. The fastener comprises an elongated filament having a first end and a second end. Disposed at the first end of the filament is a transverse cross-bar which is sized and shaped to be dispensed through an article of commerce using a tagger gun having a hollow slotted needle. Disposed at the second end of the filament is an enlarged paddle which is sized and shaped to prevent the filament from being pulled completely through the article of commerce through which the cross-bar had previously been inserted. The elongated filament is shaped to include a elongated central portion having a longitudinal axis and a first elongated rib. The first elongated rib extends along the length of the elongated central portion and serves to increase the cross-sectional surface area, and hence the tensile strength, of the elongated filament. The first elongated rib projects out from the elongated central portion of the filament at an angle perpendicular to the longitudinal axis of the central portion. In another embodiment of the present invention, the plastic fastener includes a second elongated rib which is disposed on the opposite side of the elongated central portion from the first elongated rib.

11 Claims, 4 Drawing Sheets

PLASTIC FASTENER

BACKGROUND OF THE INVENTION

The present invention relates to plastic fasteners.

Plastic fasteners of the type commonly used, for example, to attach merchandise tags to articles of commerce, such as articles of clothing, are well known and are widely used in the retail industry. Typically, such fasteners comprise an elongated member having a first end shaped to define a cross-bar (also commonly referred to as a "T-bar"), a second end and a thin filament portion interconnecting the cross-bar and the second end. In use, the cross-bar is inserted first through a tag and then through a desired piece of fabric. The second end is appropriately sized and shaped to keep the tag from being pulled off the filament portion.

Typically, such fasteners are mass-produced into one of two different forms known as fastener stock. One type of fastener stock comprises a plurality of fasteners joined together at their respective cross-bars by an orthogonally disposed runner bar. The other type of fastener stock comprises a plurality of fasteners arranged in an end-to-end alignment, the ends of successive fasteners being joined together by severable connectors so as to form a length of continuously connected fastener stock.

The dispensing of individual fasteners from fastener stock into desired articles of commerce is typically accomplished using an apparatus commonly referred to as a tagger gun. Typically, a tagger gun includes (a) a hollow needle having a longitudinal slot extending across its length; (b) means for separating an individual cross-bar from the remainder of the fastener stock; and (c) means for feeding the individual cross-bar through the hollow, slotted needle and the desired article of commerce. Connections, if any, between the ends of adjacent fasteners are severed by pulling the tagger gun away from the article of commerce after the cross-bar of one of the fasteners has been inserted thereinto.

Fastener stock is commonly mass-produced through a process of continuous molding. In U.S. Pat. No. 4,461,738 to Russell, there is disclosed a method of continuous extrusion molding of objects using a rotatable molding wheel with peripheral orifices in accordance with the objects to be molded. Plastic is extruded upon the periphery of the wheel and a knife in substantially elliptical contact is used to skive film from the objects being molded.

Typically, the process of continuous molding is capable of producing only a length of fastener stock in which each individual fastener includes a filament of reduced length and increased thickness. As a result, upon completion of the molding process, selected portions of the fasteners in the fastener stock are often subjected to a stretching process. The process of stretching fastener stock is well known in the art and is commonly used to produce fastener stock in which each individual fastener includes a filament of increased length and reduced thickness. Often the stretching process is performed using a pair of diverging sprocket wheels which rotate to stretch the filamentary portions.

It is desirable for plastic fasteners of the type described above to be manufactured in such a manner so as to have a high tensile strength. Plastic fasteners, and in particular the thin filament of plastic fasteners, require a high tensile strength for numerous reasons. For instance, plastic fasteners of the type described above must be manufactured in such a manner so as to be strong enough to prevent unscrupulous shoppers from severing the thin filament which, in turn, can enable the shopper to remove the fastener and price tag from the article of commerce without paying.

Furthermore, plastic fasteners of the type described above must be manufactured in such a manner so as to be strong enough to withstand the force of the stretching process. For example, plastic fasteners of the type commonly used for shoe-lasting applications, such as U.S. Pat. No. 5,586,353 to Merser, can require approximately 50 pounds of force to stretch the molded fastener into the finished product. Oftentimes, this amount of stretching force can exceed the tensile strength of the fastener and, as a consequence, cause the filament to sever during the stretching process.

Numerous techniques have been used to increase the tensile strength of the thin filament of plastic fasteners.

One technique employed to increase the tensile strength of fasteners is accomplished by molding the fastener stock using an inherently strong plastic material, such as nylon, instead of using an inherently weaker plastic material, such as polypropelene or polyeurethane.

One drawback of molding fasteners out of a stronger plastic, such as nylon, instead of a weaker plastic, such as polypropelene or polyeurethane, is that the stronger plastics are typically more expensive than the weaker plastics. For example, the cost of nylon is approximately twice as expensive as the cost of polypropelene and polyeurethane.

Another technique used to increase the tensile strength of fasteners is accomplished by increasing the thickness of the thin filament. It should be noted that the thickness of the cross-bar of the fastener can not be similarly increased because an increase in the cross-sectional size of the cross-bar may preclude the fastener from being able to fit within the hollow needle of conventional tagger guns.

There are numerous drawbacks which result from increasing the thickness of the thin filament.

One drawback which results from increasing the thickness of the filament is that the plastic fastener often will sever or become distorted during the stretching process. Specifically, because the thickness of the filament is increased without increasing the thickness of the cross-bar, there is exists a considerable difference in the tensile strength between the cross-bar and the filament. Furthermore, because the thickness of the filament is increased, a larger amount of force is required to stretch the filament during the stretching process, an amount of force which the weaker cross-bar is unable to withstand. As a consequence, the junction of the cross-bar and the filament may sever or become improperly distorted, the improper distortion of a stretched fastener often being referred to as necking in the art. The distortion of a fastener is significant in that the fastener may no longer be shaped so as to be able to fit through the slot of the needle of standard tagger guns.

Another drawback which results from increasing the thickness of the filament is that the thicker fastener will create a larger hole in the article of clothing being tagged. Specifically, during the tagging process of an article of clothing, a tagger gun bends the cross-bar of the fastener in a near parallel relation to the thin filament. The bending process decreases the size of the hole in the article of clothing through which the fastener needs to pass. However, because the thickness of the filament is increased for the thicker fastener, the cross-bar is not able to be bent in a near parallel relation to the filament. As a consequence, the size of the hole in the article of clothing being tagged is increased, which is undesirable.

SUMMARY OF THE INVENTION

It is an object of the present invention to provide a new and improved plastic fastener.

It is another object of the present invention to provide a plastic fastener which has a high tensile strength.

It is yet another object of the present invention to provide a plastic fastener of the described above which is inexpensive to manufacture, has a limited number of parts and is easy to use.

According to one embodiment of the present invention, there is provided a fastener for use in tagging an article of commerce, said fastener comprising an elongated filament having a first end, a second end and a longitudinal axis, and a transverse bar disposed at the first end of said elongated filament, said elongated filament being shaped to include an elongated rib.

According to another embodiment of the present invention, there is provided a fastener for use in tagging an article of commerce, said fastener comprising an elongated filament having a first end, a second end and a longitudinal axis, and a transverse bar disposed at the first end of said elongated filament, said elongated filament being shaped to include a first elongated rib and a second elongated rib.

Additional objects, as well as features and advantages, of the present invention will be set forth in part in the description which follows, and in part will be obvious from the description or may be learned by practice of the invention. In the description, reference is made to the accompanying drawings which form a part thereof and in which is shown by way of illustration various embodiments for practicing the invention. The embodiments will be described in sufficient detail to enable those skilled in the art to practice the invention, and it is to be understood that other embodiments may be utilized and that structural changes may be made without departing from the scope of the invention. The following detailed description is, therefore, not to be taken in a limiting sense, and the scope of the present invention is best defined by the appended claims.

BRIEF DESCRIPTION OF THE DRAWINGS

The accompanying drawings, which are hereby incorporated into and constitute a part of this specification, illustrate various embodiments of the invention and, together with the description, serve to explain the principles of the invention. In the drawings wherein like reference numerals represent like parts.

DETAILED DESCRIPTION OF A PREFERRED EMBODIMENT

Figure 1:
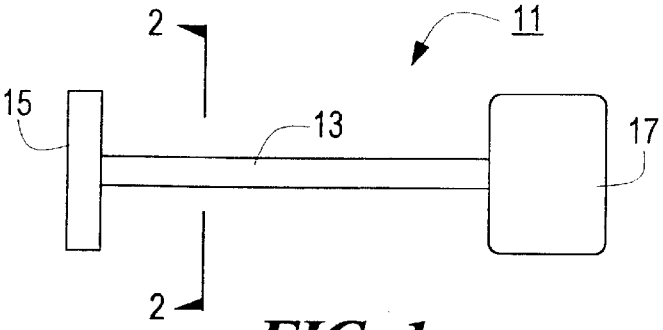
FIG. 1 PRIOR ART
FIG. 1 is a top plan view of one type of prior art plastic fastener, the fastener being shown in its unstretched state.
Figure 2:
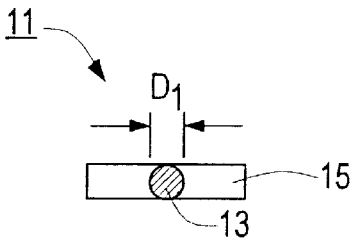
FIG. 2 is a side section view of the prior art plastic fastener shown in FIG. 1 taken along lines 2—2.

Referring now to FIGS. 1 and 2, there is a shown a prior art plastic fastener which is well known and commonly used in the art, the plastic fastener being represented generally by reference numeral 11.

Fastener 11 is constructed of a plastic material, such as polypropelene, nylon or polyeurethane, using molding techniques which are well known in the art. For example, fastener 11 can formed into a length of fastener stock using a continuous molding technique of the type disclosed in U.S. Pat. No. 4,461,738 to Russell, which is hereby incorporated by reference. It is to be noted that fastener 11 represents a plastic fastener at the stage of production after completion of the molding process but before subjection to a stretching process.

Prior art fastener 11 is shaped to define a thin, flexible filament 13, a transverse cross-bar 15 and an enlarged paddle 17, thin filament 13 interconnecting cross-bar 15 to paddle 17. As shown in FIG. 2, thin filament 13 is generally circular in cross-section and has a diameter D1.

Cross-bar 15 is connected at its approximate midpoint to one end of thin filament 13 to form a T-shaped configuration and is appropriately sized and shaped to be dispensed through an article of clothing using a tagger gun having a hollow slotted needle. Paddle 17 is connected to the opposite end of thin filament 13 and is appropriately sized and shaped to prevent flexible filament 13 from being pulled completely through the article of clothing through which cross-bar 15 has previously been inserted.

Figure 3:
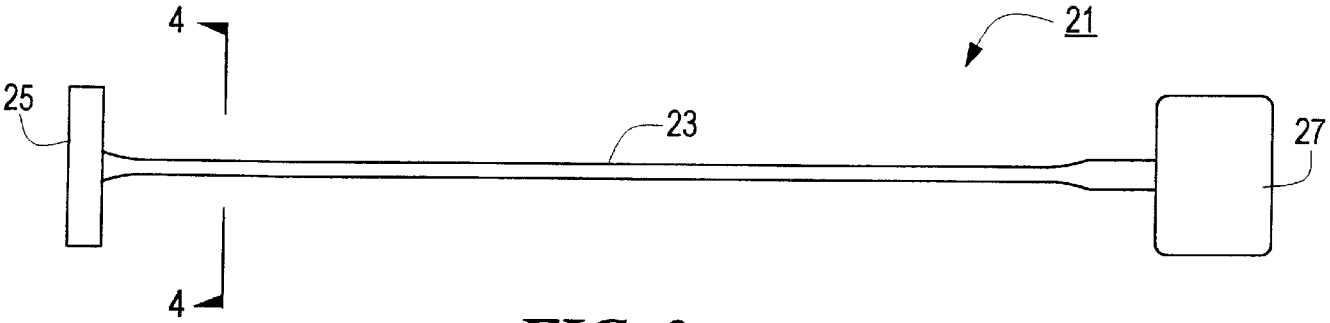
FIG. 3 PRIOR ART
FIG. 3 is a top plan view of the prior art plastic fastener shown in FIG. 1, the fastener being shown in its stretched state.
Figure 4:
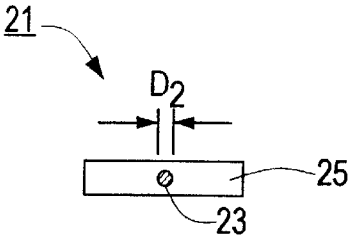
FIG. 4 is a side section view of the prior art plastic fastener shown in FIG. 3 taken along lines 4—4.

Referring now to FIGS. 3 and 4, there is shown prior art fastener 11 after being subjected to a stretching process, the stretched fastener being generally identified by reference numeral 21. Fastener 21 comprises a thin, flexible filament 23, a transverse cross-bar 25 and an enlarged paddle 27, thin filament 23 interconnecting cross-bar 25 to paddle 27. Fastener 21 is a unitary member of the type which is commonly used to attach a tag to an article of clothing.

Stretched fastener 21 is identical to fastener 11 in all regards except for the size and shape of the thin filament. Specifically, thin filament 23 has been subjected to a stretching process whereas thin filament 13 has not been subjected to a stretching process. As a consequence, thin filament 23 has a considerably longer length and considerably smaller cross-sectional diameter D2 than thin filament 13, which makes filament 23 more flexible than filament 13.

Although prior art fastener 21 is commonly used in the art, the particular construction of fastener 21 creates a relatively low tensile strength in thin filament 23. Due to its low tensile strength, filament 23 can be easily severed, such as by an unscrupulous shopper or during the stretching process. Accordingly, it is desirable to construct a plastic fastener having a thin filament of increased tensile strength.

One technique commonly employed to increase the tensile strength of the thin filament is to mold the fastener using an inherently strong plastic material, such as nylon, instead of using an inherently weaker plastic material, such as polypropelene or polyeurethane. However, it should be noted that strong plastics, such as nylon, are considerably more expensive than weaker plastics, such as polypropelene, and therefore serve to increase the overall cost to manufacture the fastener, which is undesirable.

Figure 5:
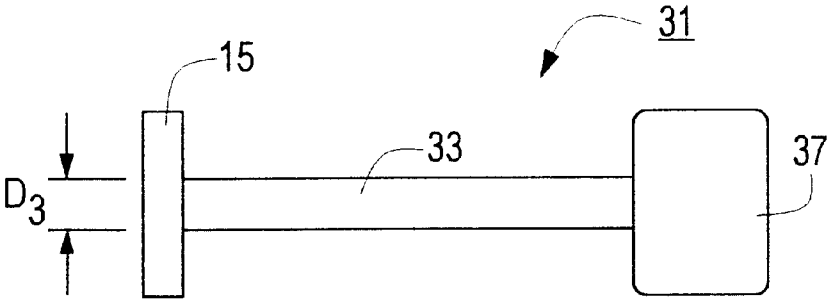
FIG. 5 PRIOR ART
FIG. 5 is a top plan view of another type of prior art plastic fastener, the fastener being shown in its unstretched state.

Another technique commonly employed to increase the tensile strength of the thin filament of a fastener is to increase the thickness of the filament. Referring now to FIG. 5, there is shown prior art plastic fastener having a filament of increased thickness, the plastic fastener being generally represented by reference numeral 31.

Prior art fastener 31 is shaped to define a thin, flexible filament 33, a transverse cross-bar 35 and an enlarged paddle 37, thin filament 33 interconnecting cross-bar 35 to paddle 37.

Prior art fastener 31 is identical to fastener 11 in all regards except for the thickness of the thin filament. Specifically, thin filament 33 has a thicker diameter D3 than diameter D1 of filament 13. As a consequence, thin filament 33 has a considerably greater tensile strength than thin filament 13, which is highly desirable.

However, prior art fastener 31 tends to experience problems when subjected to a stretching process. In particular, because the thickness of filament 33 is greater than the thickness of cross-bar 35, there exists a considerable difference in tensile strength between cross-bar 35 and filament 33. Furthermore, because the thickness of filament 33 is relatively large, a larger amount of force is required to stretch filament 33 during the stretching process, an amount of force which cross-bar 35 is unable to withstand.

Figure 6:
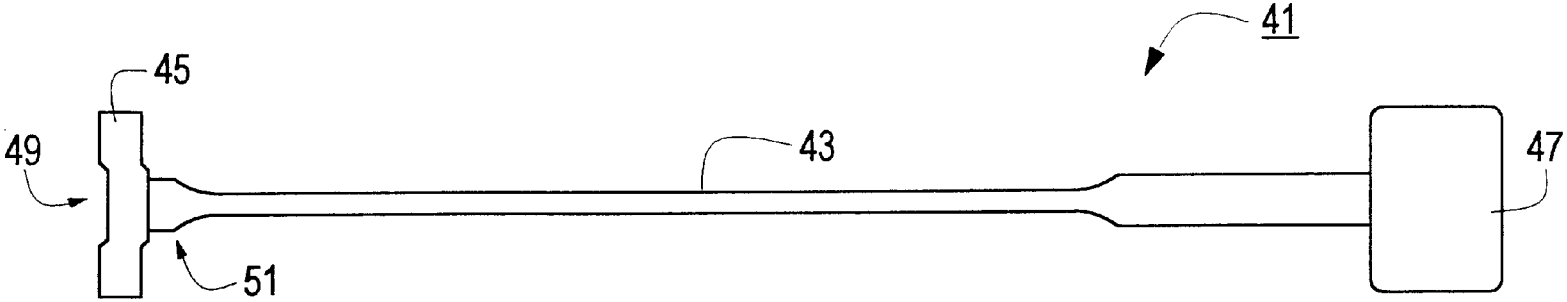
FIG. 6 PRIOR ART
FIG. 6 is a top plan view of the prior art plastic fastener shown in FIG. 5, the fastener being shown in its stretched state.

Referring now to FIG. 6, there is shown prior art fastener 31 after being subjected to a stretching process, the stretched fastener being identified generally by reference numeral 41. Stretched prior art fastener 41 comprises a thin, flexible filament 43, a transverse cross-bar 45 and an enlarged paddle 47, thin filament 43 interconnecting cross-bar 45 to paddle 47.

As noted above, fastener 41 experiences problems when stretched. Specifically, the junction of cross-bar 45 and filament 43 may become improperly distorted, as shown in FIG. 6, or even severed (not shown) during the stretching process. The improper distortion of fastener 41, also commonly referred to as necking, creates a recess 49 in cross-bar 45 and an unstretched portion 51, or reservoir, in filament 43. Portion 51 may be large enough to prevent fastener 41 from fitting through the slot of the needle of a standard tagger gun, thereby precluding its use.

It should also be known that the increased thickness of filament 43 precludes cross-bar 45 from properly bending towards filament 43 during the tagging process of an article of clothing. As a consequence, fastener 41 will create a substantially larger hole in the article to be tagged than prior art fastener 21, which is undesirable.

Figure 8:
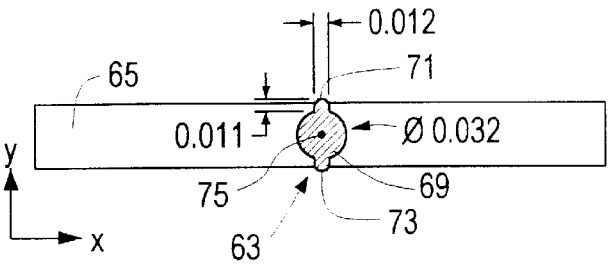
FIG. 8 is an enlarged, side section view of the plastic fastener shown in FIG. 7 taken along lines 8—8.
Figure 7:
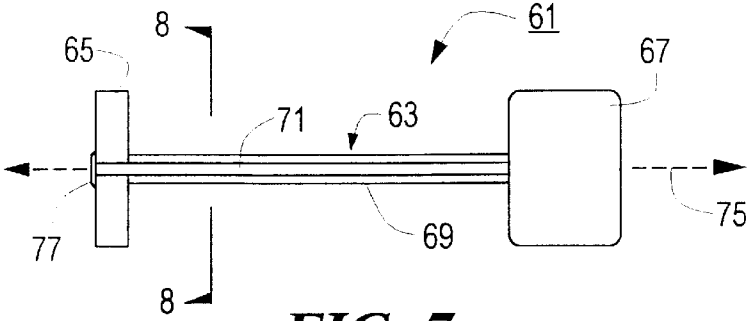
FIG. 7 is a top plan view of a first embodiment of a plastic fastener constructed according to the teachings of the present invention, the fastener being shown in its unstretched state.

Referring now to FIGS. 7 and 8, there is shown a first embodiment of a plastic fastener constructed according to the teachings of the present invention, the plastic fastener being represented generally by reference numeral 61.

Fastener 61 is shaped to define a thin, flexible filament 63, a transverse cross-bar 65 and an enlarged paddle 67, thin filament 63 interconnecting cross-bar 65 to paddle 67.

Thin, flexible filament 63 comprises an elongated central portion 69, a first elongated rib 71 and a second elongated rib 73. Central portion 69 is generally circular in cross-section and includes an elongated longitudinal axis 75. First and second elongated ribs 71 and 73 are positioned on opposite sides of central portion 69 and extend along its length. First and second ribs 71 and 73 are generally semicircular in cross-section and project out from central portion 69 at an angle perpendicular to longitudinal axis 69.

As can be appreciated, ribs 71 and 73 serve to increase the overall cross-sectional surface area of filament 63, and hence its overall tensile strength, without introducing any of the drawbacks associated with prior art fasteners 11 and 31. Ribs 71 and 73 serve to increase the cross-sectional surface area of filament 63 without introducing any of the drawbacks associated with prior art fasteners by increasing the thickness of filament 63 (increasing size of filament 63 in the direction of the Y-axis shown in FIG. 8) and not by increasing the width of filament 63 (increasing size of filament 63 in the direction of the X-axis shown in FIG. 8). It is for this reason that fastener 61 does not distort, or neck, in the manner in which fastener 41 distorts during the stretching process.

Cross-bar 65 is connected at its approximate midpoint to one end of thin filament 63 to form a T-shaped configuration and is appropriately sized and shaped to be dispensed through an article of clothing using a tagger gun having a hollow slotted needle. Cross-bar 65 comprises a reinforcement portion 77 to prevent cross-bar 65 from bending during the stretching process in the manner in which prior art fastener 41 bends to form recess 49.

Paddle 67 is connected to the end of thin filament 63 opposite cross-bar 65. Paddle 67 is appropriately sized and shaped to prevent flexible filament 63 from being pulled completely through the article of clothing through which cross-bar 65 has previously been inserted.

Figure 9:
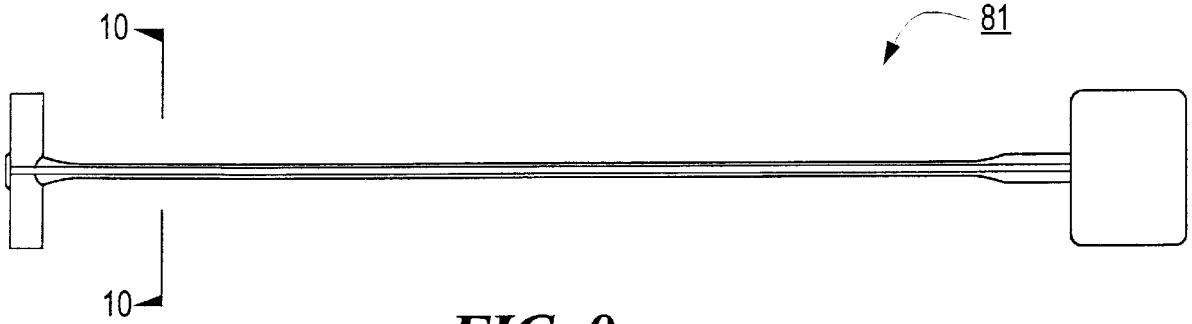
FIG. 9 is a top plan view of the plastic fastener shown in FIG. 7, the fastener being shown in its stretched state.
Figure 10:
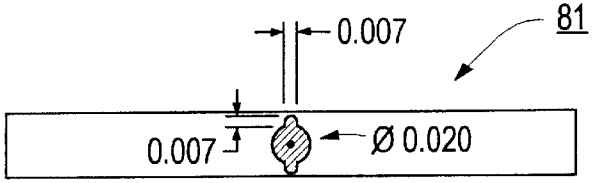
FIG. 10 is an enlarged, side section view of the plastic fastener shown in FIG. 9 taken along lines 10—10.

Referring now to FIGS. 9 and 10, there is shown plastic fastener 61 after being subjected to a stretching process, the stretched fastener being identified generally by reference numeral 81. As noted above, fastener 81 does not experience the numerous drawbacks associated with stretched prior art fasteners 21 and 41.

Figure 11:
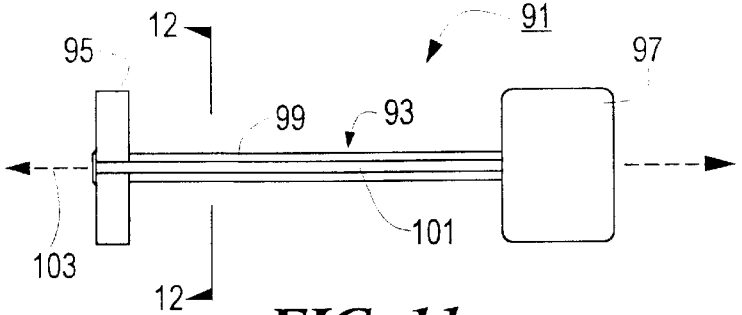
FIG. 11 is a top plan view of a second embodiment of a plastic fastener constructed according to the teachings of the present invention, the fastener being shown in its unstretched state.

Referring now to FIGS. 10 and 11, there is shown a second embodiment of a plastic fastener constructed according to the teachings of the present invention, the plastic fastener being represented generally by reference numeral 91.

Fastener 91 is shaped to define a thin, flexible filament 93, a transverse cross-bar 95 and an enlarged paddle 97, thin filament 93 interconnecting cross-bar 95 to paddle 97.

Figure 12:
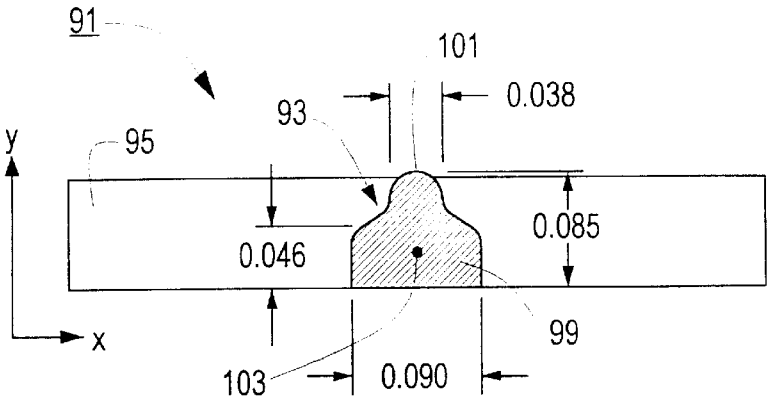
FIG. 12 is an enlarged, side section view of the plastic fastener shown in FIG. 11 taken along lines 12—12.

Fastener 91 is identical to fastener 61 except in regards to the construction of the thin filament. Notably, fastener 91 is shaped to include only one elongated rib whereas fastener 61 is shaped to include two elongated ribs. Flexible filament 93 comprises an elongated central portion 99 and an elongated rib 101. Central portion 99 is generally rectangular in cross-section and includes an elongated longitudinal axis 103. Elongated rib 101 is positioned on central portion 99 and extends along its length. Elongated rib 101 is generally semicircular in cross-section and projects out from central portion 99 at an angle perpendicular to longitudinal axis 103, rib 101 projecting in the direction of the Y-axis as shown in FIG. 12.

As can be appreciated, rib 101 serves to increase the overall cross-sectional surface area of filament 93, and hence its overall tensile strength, without introducing any of the drawbacks associated with prior art fasteners 11 and 31, which is highly desirable. Rib 101 serves to increase the cross-sectional surface area of filament 93 without introducing any of the drawbacks associated with prior art fasteners by increasing the thickness of filament 93 (increasing size of filament 93 in the direction of the Y-axis shown in FIG. 12) and not by increasing the width of filament 93 (increasing size of filament 93 in the direction of the X-axis shown in FIG. 12). It is for this reason that fastener 91 does not distort, or neck, in the manner in which fastener 41 distorts during the stretching process.

Figure 13:
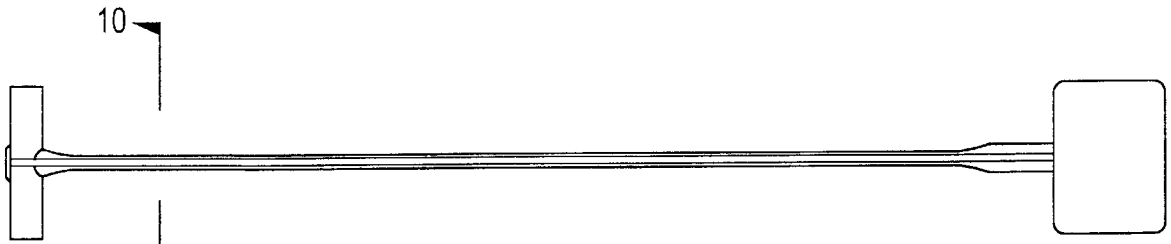
FIG. 13 is a top plan view of the plastic fastener shown in FIG. 11, the fastener being shown in its stretched state.
Figure 14:
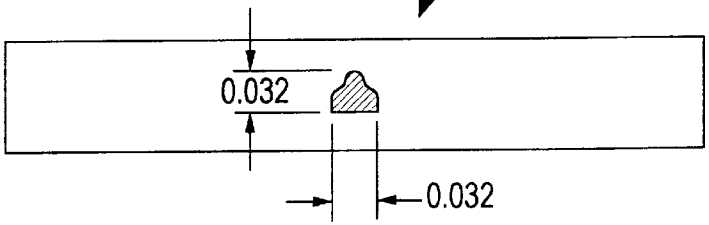
FIG. 14 is an enlarged, side section view of the plastic fastener shown in FIG. 13 taken along lines 14—14.

Referring now to FIGS. 13 and 14, there is shown plastic fastener 91 after being subjected to a stretching process, the stretched fastener being identified generally by reference numeral 111. As noted above, fastener 111 does not experience the numerous drawbacks associated with stretched prior art fasteners 21 and 41.

The embodiments of the present invention described above are intended to be merely exemplary and those skilled in the art shall be able to make numerous variations and modifications to it without departing from the spirit of the present invention. All such variations and modifications are intended to be within the scope of the present invention as defined in the appended claims.

What is claimed is:

1. A fastener for use in tagging an article of commerce, said fastener comprising:

a. an elongated filament having a first end and a second end; and b. a transverse bar disposed at the first end of said elongated filament;

c. said elongated filament being shaped to include an elongated central portion, a first elongated rib and a second elongated rib, said first and second ribs extending along the length of said elongated filament, said first and second elongated ribs being positioned on opposite sides of said elongated central portion, each of said first and second ribs projecting out from said elongated central portion at an angle perpendicular to said elongated central portion and at an angle perpendicular to said transverse bar.

2. The fastener of claim 1 wherein said transverse bar is disposed perpendicularly to the longitudinal axis of the elongated central portion.

3. The fastener of claim 2 further comprising a paddle disposed at the second end of said elongated filament.

4. A fastener for use in tagging an article of commerce, said fastener comprising:

a. an elongated filament having a first end and a second end;

b. a transverse bar disposed at the first end of said elongated filament; and c. a paddle disposed at the second end of said elongated filament;

d. said elongated filament being shaped to include an elongated central portion and an elongated rib;

e. said elongated rib extending along the length of said elongated filament;

f. said elongated rib projecting out form said elongated filament at an angle perpendicular to said elongated central portion and at an angle perpendicular to said transverse bar;

g. said transverse bar being disposed perpendicularly to the longitudinal axis of the elongated central portion and including a reinforcement portion at its midposition to prevent said transverse bar from bending during fabrication of said fastener thereof.

5. The fastener of claim 4 wherein said fastener is made of plastic.

6. The fastener of claim 5 wherein said fastener is made of polypropelene.

7. The fastener of claim 6 wherein the elongated central portion is generally rectangular in cross-section.

8. A fastener for use in tagging an article of commerce, said fastener comprising:

a. an elongated filament having a first end and a second end;

b. a transverse bar disposed at the first end of said elongated filament;

c. a paddle disposed at the second end of said elongated filament;

d. said elongated filament being shaped to include an elongated central portion having a longitudinal axis, a first elongated rib and a second elongated rib, said first and second ribs extending along the length of said elongated filament, said first and second elongated rigs being positioned on opposite sides of said elongated central portion, each of said first and second ribs projecting out from said elongated central portion at an angle perpendicular to said elongated central portion and at an angle perpendicular to said transverse bar;

e. said transverse bar being disposed perpendicular to the longitudinal axis of the elongated central portion and including a reinforcement portion at its midposition to prevent said transverse bar from bending during fabrication of said fastener.

9. The fastener of claim 8 wherein said fastener is made of plastic.

10. The fastener of claim 9 wherein said fastener is made of polypropelene.

11. The fastener of claim 10 wherein said elongated central portion is generally circular in cross-section.

* * * * *